US006286987B1

(12) United States Patent
Goode et al.

(10) Patent No.: US 6,286,987 B1
(45) Date of Patent: Sep. 11, 2001

(54) SYSTEM AND METHOD FOR CONTROLLING THE SPEED OF AN ENGINE PROVIDING POWER TO A CONCRETE MIXING DRUM

(75) Inventors: Charles E. Goode, Columbus; Donald L. Banks, Indianapolis, both of IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/430,220

(22) Filed: Oct. 29, 1999

(51) Int. Cl.[7] ..... B28C 7/00
(52) U.S. Cl. ..... 366/60; 123/352
(58) Field of Search ..... 366/53–59, 60, 366/61, 220–231, 601; 123/352; 417/12, 34

(56) References Cited

U.S. PATENT DOCUMENTS

| | | | | |
|---|---|---|---|---|
| 2,781,186 | * | 2/1957 | Harbers et al. . | |
| 3,160,398 | * | 12/1964 | Green . | |
| 3,371,543 | * | 3/1968 | Jackson et al. . | |
| 3,460,812 | * | 8/1969 | Kaufman . | |
| 3,491,734 | * | 1/1970 | Mackowiak . | |
| 3,627,281 | | 12/1971 | Peterson . | |
| 3,773,304 | | 11/1973 | Hodgson . | |
| 4,372,265 | | 2/1983 | Kasiewicz . | |
| 4,400,935 | * | 8/1983 | Louis | 417/34 |
| 4,585,356 | | 4/1986 | Hudelmaier . | |
| 4,752,134 | | 6/1988 | Milek . | |
| 4,779,591 | | 10/1988 | Tordenmaim . | |
| 4,832,498 | | 5/1989 | Milek . | |
| 4,846,581 | * | 7/1989 | Osterlund et al. | 366/61 |
| 4,898,137 | * | 2/1990 | Fujita et al. | 123/352 |
| 4,900,154 | | 2/1990 | Waitzinger et al. . | |
| 4,989,567 | | 2/1991 | Fujioka . | |
| 5,611,751 | | 3/1997 | Ehrenhardt et al. . | |
| 5,740,044 | | 4/1998 | Ehrenhardt et al. . | |
| 5,752,768 | | 5/1998 | Assh . | |
| 5,884,998 | * | 3/1999 | Silbernagel | 366/59 |

FOREIGN PATENT DOCUMENTS

| | | | | |
|---|---|---|---|---|
| 2103339 | * | 2/1983 | (GB) | 366/61 |
| 59-16531 | * | 1/1984 | (JP) | 366/61 |

* cited by examiner

*Primary Examiner*—Charles E. Cooley

(57) ABSTRACT

A system for controlling the speed of an engine in a vocational application is implemented within a mobile cement mixer. The system permits operation of the engine at a high rpm PTO speed to drive the mixing drum at a recommended speed for optimal full mixing of aggregate within the drum. The system maintains the engine at this high rpm only for a predetermined time period necessary for full mixing. After expiration of the time period, the system directs the engine governor to drop the engine speed to low idle, thereby preventing overworking of the cement, reducing the abrasive effect of the aggregate on the interior of the mixing drum, and improving engine fuel economy. In one embodiment, the system permits operator entry of drum rotation speed and total drum revolutions, which are then used to calculate the time period value. In another embodiment, the input is number of drum rotations and the system uses a signal from a drum rotation counter to control the high rpm—low idle speed change of the engine.

19 Claims, 5 Drawing Sheets

SYSTEM AND METHOD FOR CONTROLLING THE SPEED OF AN ENGINE PROVIDING POWER TO A CONCRETE MIXING DRUM

BACKGROUND OF THE INVENTION

This invention relates to vocational trucks, such as cement mixers, and particularly to systems and methods for controlling the engine of the truck. More specifically, the invention relates to systems for controlling the engine speed in different operational modes of the vocational truck.

Most vocational trucks are driven by internal combustion engines, such as diesel engines. One such vocational truck is the well-known mobile cement mixer, that carries a charge of concrete from an aggregate batch plant to a remote job site.

For most construction sites, it is customary to have the concrete delivered by these mobile cement mixers. The vehicles are loaded with sand, stone, cement and water, in the correct proportions to meet industry-wide concrete specifications. These concrete specifications typically require that the concrete on arrival at the job site be guaranteed to achieve a minimum specified strength ninety-nine percent (99%) of the time.

Once the mixing drum of the mobile cement mixer has been charged with all the necessary ingredients, the mixing cycle can commence. In the instances in which a dry batch is being hauled by the mixer, some nominal agitation of the dry mix occurs before and during transit. The critical mixing occurs when water is added to the dry batch. In some cases, water can be added at the batch facility, so that more significant agitation or mixing of the wet batch must be accomplished during transit to the job site.

The strength of the concrete when ultimately set, and its workability at the job site, are critically dependent on the mixing regime that is followed. Certain standards have been developed and are generally adhered to in the industry. Once such standard is the Truck Mixer Manufacturer's Bureau (TMMB) standard that provides the following recommended criteria for the mixing of a full load of concrete:

1. Mixing turns: 70–100 turns at 6–18 rpm;
2. On addition of further water, a minimum of 30 additional turns at mixing speed; and
3. Holding or agitation turns at no greater than 6 rpm for no more than 300 total turns including mixing turns.

Once the concrete has been properly and consistently mixed according to the above protocol, it is also important to maintain a minimum degree of further agitation to prevent separation of the aggregate material. Preferably, this agitation occurs at about 1.5–2.5 rpm. Any greater rotational speed can accelerate the setting of the concrete by overworking.

Traditionally, responsibility for controlling the rate and duration of rotation of the mixing drum has been left to the vehicle operator. The vehicle operator can control the speed and duration of the rotation of the mixing drum by controlling the mixing drum drive system. Typically, this system includes a hydraulic motor that rotates the drum, and a variable-stroke hydraulic pump that provides hydraulic fluid to the motor. The vehicle operator can control the speed of rotation of the mixing drum by operation of a stroke control arm on the hydraulic pump. Hydraulic motors and control systems of this type are well known in the art. Of course, other devices that permit controllable rotation of the mixing drum are contemplated by the present invention.

The mixing drum speed is a function of the vehicle engines speed. In vocational truck applications, the engine is provided with a power take-off (PTO) that diverts engine power from the driven wheels to an auxiliary driven component. In the case of a mobile cement mixer, the driven components is the hydraulic pump and motor power train driving the mixing drum.

In a typical scenario, once the vehicle mixing drum has been filled with a full charge of ingredients, the operator will set the hydraulic pump to obtain the maximum rate of drum rotations within the recommended mixing speed range. This mixing step occurs while the vehicle is at the aggregate batch plant since it is dangerous to drive the vehicle while the drum is rotating at a high speed.

Typically, the vehicle engine will be operated at a high rpm level to drive the PTO in the mixing mode. This high rpm is significantly higher than the usual idle speed when the vehicle is stationary, in order to provide adequate power and/or to drive the mixing drum.

On departure, the vehicle operator will set the stroke to the agitation speed. At this setting, the rate of rotation of the drum depends upon the vehicle engine speed, which can lead to significantly variability in the agitation speed of the drum.

One problem that is encountered with cement mixers is caused by the abrasive effect of the aggregate mixture. More specifically, the concrete materials cause significant wear on the interior surface and mixing vanes of the mixing drum. The amount of wear and damage is a function of the speed of rotation of the mixing drum and ultimately the abrasive aggregate contained therein. In addition, excessive rotation of the mixing drum at mixing speeds increases the fuel usage for the engine, leading to a serious drop in fuel economy for the vehicle.

Consequently, there is a tradeoff between operating the mixing drum for ideal mixing of the aggregate, and the damage to the mixing drum and decreased fuel economy of the engine. Thus far, no engine control system has been developed that optimizes both sides of this tradeoff. More particularly, no system exists that automatically controls the vehicle engine to minimize the amount of time that the engine is running at its high rpm PTO output speed, while insuring that the aggregate within the mixing drum is fully mixed.

SUMMARY OF THE INVENTION

These and other problems with prior engine control systems are addressed by the systems and methods of the present invention. In one embodiment, particularly suited for cement mixers, an engine speed governor is operable to maintain the engine at a low idle speed, and a high rpm at which the mixing drum is rotated at an optimal speed. This optimal speed can be a predetermined mixing speed for complete mixing of a full load of aggregate and water within the mixing drum. The predetermined mixing speed can be obtained from industry or code standards.

The industry standard also dictates a drum rotation limit for complete mixing without overworking the cement. This standard or predetermined number of drum rotations, together with the drum rotation speed, are used by the inventive system to calculate a drum rotation time limit. A timer within the system measures the elapsed time and compares it to the rotation time limit value. Once the timer expires, the system directs the engine speed governor to automatically drop the engine speed from the high rpm to the low idle speed. In this way, the present invention prevents overworking of the fully mixed cement, reduces the wear and tear experienced by the mixing drum due to agitation of the aggregate material, and improves engine fuel economy by limiting the amount of time that the engine is running at its high rpm.

In one embodiment, a panel within the cement mixing vehicle includes a pair of input switches that allow the operator to select a predetermined drum rotation speed and number of revolutions. The system includes a drum rotation module that then calculates the drum rotation time limit and performs the timer functions described above. The user input switches can permit entry of specific values, selection from among an array of predetermined values, or increment/decrement from a fixed initial value.

In another embodiment, a drum rotation counter can provide signals to the drum rotation module. These signals can be used to count the current number of drum rotations for comparison to a predetermined value. In this instance, the operator input of the number of drum revolutions will constitute this predetermined value. When using this approach, the system directs operation of the engine at high rpm until the current number of drum revolutions exceeds the predetermined value. At that point, the system directs the engine speed governor to drop the engine speed to low idle.

In the preferred embodiment, the drum rotation module is part of the engine control module (ECM). The module is also preferably software-based, utilizing the ECM memory to store the calculated drum rotation time or the number of drum revolutions limit values.

It is one object to provide an engine control system that automatically controls the engine speed between at least two speed conditions. More specifically, an object accomplished by the invention limits the length of time that the engine is operating at a high rpm, automatically reducing the speed to low idle upon an expiration event.

One benefit of the invention is that the engine is operated at its higher speeds only as long as necessary for a particular vocational or industrial application. Another benefit enjoyed for cement mixer applications is the reduction in wear on the mixing drum attributable to rotating a full mixing drum at too high a speed for too long a time period.

Other objects and benefits of the invention can be readily discerned from the following written description together with the accompanying figures.

DESCRIPTION OF THE PREFERRED EMBODIMENTS

Figure 1:
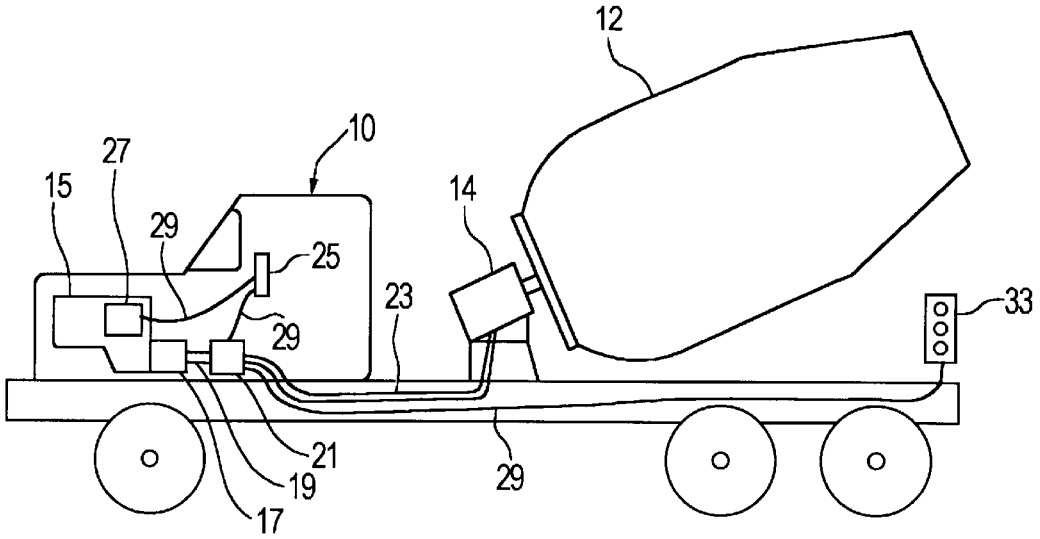
FIG. 1 is a side view of a mobile cement mixing vehicle.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The preferred embodiment of the present invention contemplates the use of an engine control system to ultimately control the rotation of a mixing drum for a cement mixing vehicle. In particular, the mixing drum is driven by a power take-off (PTO) driven by the internal combustion engine. The vehicle engine has a speed governor that maintains the engine at a particular speed. For example, when the vehicle is stationary or parked, the engine is operated at "low idle" speed, which is typically in the range of 700–800 rpm.

For vocational vehicles, such as a cement mixing truck, the engine is connected to a power take-off (PTO) assembly that diverts engine power away from the vehicle drive transmission to the drive mechanism for rotating the concrete mixing drum. When the engine is placed in the PTO mode, it is typically operated at a high rpm. This speed is usually in the neighborhood of 1200–2000 rpm. This high rpm is necessary to provide sufficient power and/or to the PTO and apparatus driven by the PTO, such as the cement mixing drum.

In one aspect of the invention, a system and method is provided for automatically controlling the engine speed based upon the mixing requirements of the aggregate within the mixing drum. In particular, the system and method permits operation of the engine at its high rpm only for a fixed period of time based upon the mixing requirements. Once the mixing drum has been rotated a requisite number of turns at its mixing speed, the engine speed governor is directed to control the engine's speed at its low idle condition. In this way, the mixing drum is operated at mixing speeds only for so long as is required. Likewise, the vehicle engine is operated at its high rpm for as short a period of time as possible.

In accordance with a preferred embodiment of the present invention, a cement mixing truck 10 includes a mixing drum 12, as shown in FIG. 1. The mixing drum is propelled by a drive motor 14 that is operable to rotate the drum at variable speeds. The vehicle includes an engine 15, which is preferably an internal combustion engine, and most preferably a diesel engine, as is typical for vocational vehicles of this sort. While the engine 15 is provided to drive the vehicle wheels through a traditional transmission, the vehicle also includes a power take-off (PTO) assembly 17. The PTO assembly is typically in the form of a transmission that is selectively connected to the drive shaft of the engine.

The PTO 17 includes an output shaft 19 that is connected to a drum motor controller 21. This drum motor controller provides power to the drive motor 14 through a power line 23. In a typical mixing truck, the drive motor 14 is a hydraulic motor, while the motor controller 21 is a variable stroke hydraulic pump. The amount of stroke of the pump 21 determines the amount of hydraulic fluid provided along lone 23 to the motor 14, which in turn determines the rotational speed of the motor 14 and ultimately the mixing drum 12. As thus described, the mixing truck 10 is a well known design for applications of this type.

The vehicle 10, and more specifically the engine 15, includes an engine control module (ECM) 27 that controls the operation of the engine. The ECM typically receives a variety of signals from sensors disposed about the engine and vehicle. The ECM implements control routines that provide signals to various fluids and mechanical components controlling the operation of the engine 15. For example, the ECM 27 controls the air-fuel mixture provided to each cylinder of the engine, as well as the ignition sequence and duration.

In one embodiment of the invention, the mixing truck 10 includes a cab control panel 25 that is linked by a data bus 29 to the ECM 27 and to the drum motor controller 21. The control panel preferably provides a means for placing the engine 15 in the PTO mode so that the mixing drum 12 can be rotated at its mixing speed. As indicated above, it is dangerous to drive the mixing drum 12 at higher speeds while the vehicle is mobile. Thus, the control panel 25 in combination with the ECM 27, can provide some safety mechanism to prevent entry into the high idle mode while the vehicle is moving. At the same time, auxiliary power can be fed through the PTO 17 to drive the mixing drum 12 at its minimum agitation speed, usually in the range of 1.5–2.5 rpm.

The vehicle 10 is also provided with a drum control switch 33 that is usually situated at the rear of the vehicle. This drum control switch 33 includes a number of switches that can be actuated by the operator to control various functions of the mixing drum. For instance, the typical drum controller 33 can increase the drum speed to the mixing speed, return the drum to its agitation speed, and reverse the rotation of the drum when concrete is to be dispensed at the job site. Preferably, the control switch 33 is also connected to the data bus 29, which provides data communication between all of the input devices, the ECM and the drum motor control switch 21.

Figure 2:
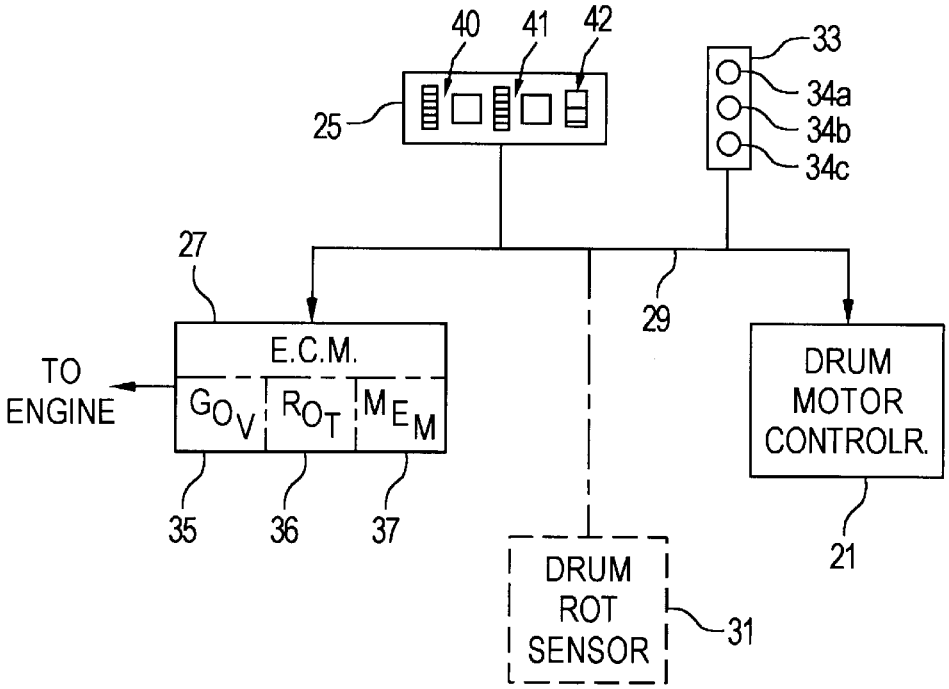
FIG. 2 is a schematic representation of components of the engine control system for use with a mixing vehicle shown in FIG. 1.

Additional details of the functional components of the inventive system are shown in FIG. 2. As illustrated schematically in the figure, the ECM 27, the mixing drum motor controller 21, the cab control panel 25 and the drum control switch 33 are connected by the data bus 29. The ECM 27 includes a number of modules that perform various engine control functions. In accordance with the preferred embodiment, the ECM is a microprocessor or microcontroller that is operable to execute a sequence of software instructions. The ECM receives data from various sensors and applies that data to the software routines to generate control signals provided to the engine, output signals provided to various annunciates or displays, and data transmission signals received by external data tools.

According to the present invention, the ECM 27 includes an engine speed governor module 35. The module 35 controls the signals provided to the engine to limit the engine speed to a particular value. For example, the governor module can form part of the vehicle cruise control system, and/or can provide an absolute limit speed for the engine. Most pertinent to the preferred embodiment of the present invention is the capability of the governor module 35 to control and maintain the engine low idle and high rpms. As explained above, the low idle speed is generally reserved for neutral or stationary operation of the vehicle engine—i.e., the vehicle is not mobile and no significant accessory or PTO output is required. The engine is typically placed in the low idle condition during various diagnostic and data transmission functions. The governor module 35 can also maintain the engine speed at high idle value, particularly as required during full PTO operation. The governor monitors and compensates for engine speed fluctuations due to variations in PTO load.

The present invention contemplates a variety of engine speed governor modules 35. In the preferred embodiment, the module 35 is a software based system implemented within the ECM 27. However, electronic speed governors or various types of microprocessor-based governors are contemplated for use with the present invention. The governor module must be capable of controlling the engine at various discrete speeds. For example, instead of a high rpm in the range of 1200–2000 rpm, the governor module 35 can have the capability of controlling the engine at a much higher speed, based upon the energy requirements during PTO operation of the vehicle. Similarly, the governor module can control the engine at a speed above the low idle speed, again as might be dictated by the application of the particular vocational vehicle.

One important aspect of the invention is accomplished by the capability of the speed governor module 35 to control the engine at a relatively high and a relatively lower speed, with the understanding that the operation of the engine at the relatively lower speed achieves certain benefits over operation of the engine at the higher speed. One benefit is the increase in fuel economy accomplished by minimizing the amount of time that the vehicle engine operates at the higher speed. In the preferred embodiment of the invention implementing a cement mixing truck, a further benefit resides in minimizing the amount of time that the mixing drum 12 rotates at its higher speed, which therefore minimizes the abrasive effect of aggregate components rotating within the drum.

In a further aspect of the ECM 27, a drum rotation module 36 is provided. This rotation module 36 provides commands to the engine speed governor module 35 to direct the governor to control the engine at either the higher or the lower speed. In the specific preferred embodiment, the rotation module 36 determines when the governor module 35 should maintain the engine at the high rpm or the low idle speed. Details of this module can be discerned from the flow charts of the following figures.

A further component of the ECM 27 is a memory 37. The memory can be used to store various operational constants and variable values, as well as data accumulated during the operation of the engine.

Referring still to FIG. 2, the manual control switch 33 includes a number of user operated switches 34*a*–34*c*. Typically, these switches can be the push button on-off variety. In a typical installation, the manual control switch 33 includes a mixing speed enable switch 34*a*, a disable switch 34*b*, and a reverse rotation switch 34*c*. Rotation of the mixing drum 12 at its preferred mixing speed can be initiated by activation of the switch 34A. Deactivation of the mixing speed, or return of the mixing drum 12 to its agitation speed, can be accomplished by depressing switch 34*b* finally, when it is time to discharge concrete at the job site. Since the manual control switch 33 is connected to the data bus 29, operation of the control switches 34*a*–34*c* transmits data to the ECM for use by the control modules or for storage in memory 37. In addition, the control switch 33 provides control signals to the drum motor controller 21, such as to initiate mixing speed operation of the drum 12.

Figure 3:
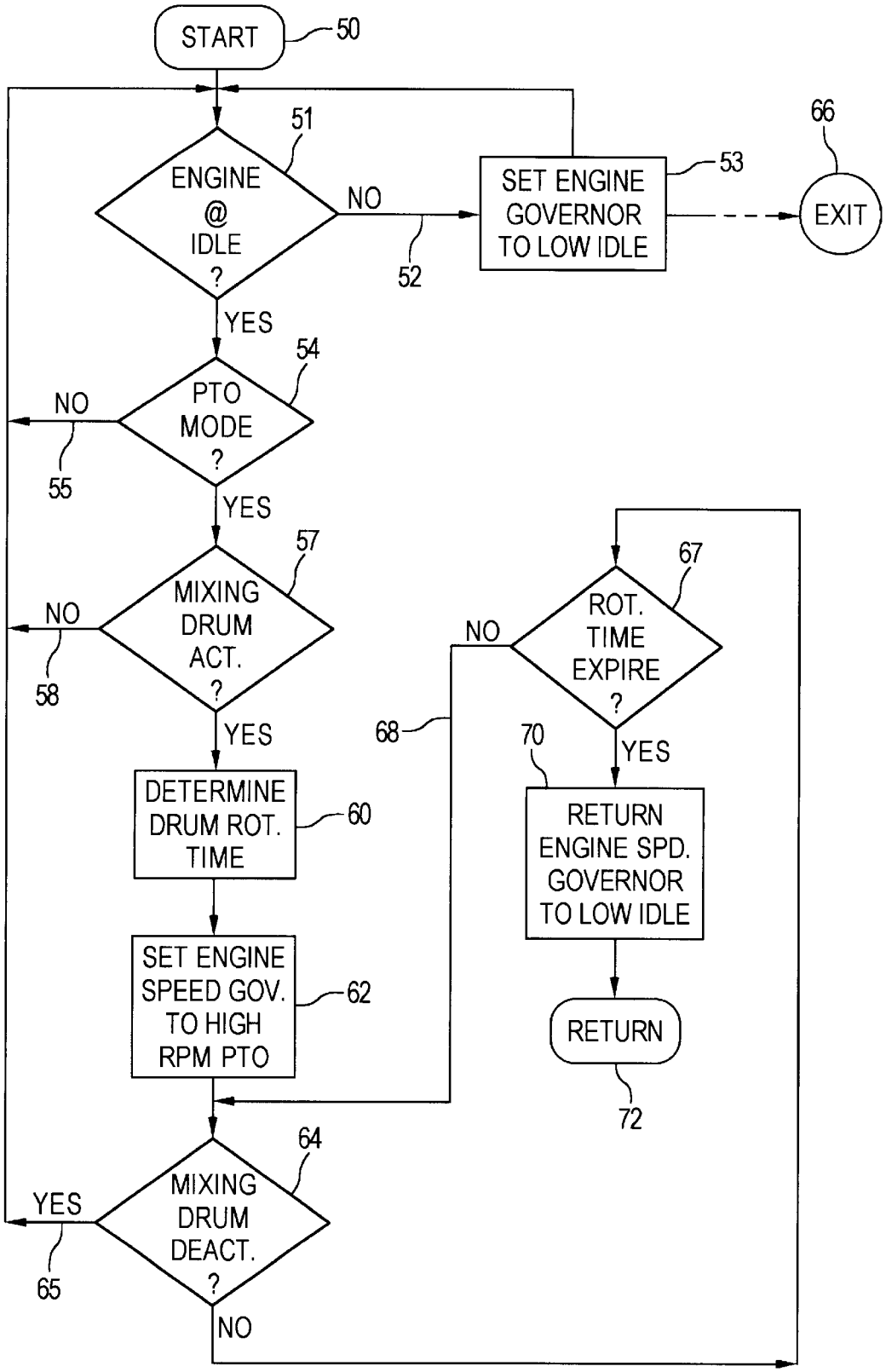
FIG. 3 is a flow chart of a sequence of steps that can be executed by the engine control system shown in FIG. 2 in accordance with one embodiment of the present invention.

Referring now to FIG. 3, details of one embodiment of the drum rotation module 36 are depicted. In particular, FIG. 3 is a flow chart representative of a sequence of software instructions executed by the rotation module 36. The routine is started at step 50, preferably in response to a drum mixing speed activation signal. Specifically, the routine can be commenced when the mixing drum 12 is directed to be rotated at the appropriate speed for mixing the aggregate within the drum. Preferably, the start signal is issued by the manual control switch 33, such as by activation of the switch 34*a*. The manual control switch 33 then conveys a signal along databus 29 to ECM 27. Upon receipt of this signal, the ECM can execute the sequence of instructions shown in the flow chart of FIG. 3.

In one embodiment of the invention, the module 36 determines in step 51 whether the engine is operating at its low idle condition. This conditional step can be satisfied by interrogating the governor module 35 or the ECM 27 to determine the current engine speed. The routine continues on loop 52 as long as the engine is not at the low idle speed. This conditional step 51 and loop 52 prevents activation of the drum rotation module when the engine is running too fast, such as might occur when the vehicle is on road.

When the engine is at low idle speed, control passes to the conditional step 54 in which it is determined whether the engine is operating in PTO mode. In this mode, all of the engine power is diverted through the PTO 17, and ultimately to the drum motor controller 21. If the conditional step 54 fails, control passes at loop 55 to the beginning of the routine.

On the other hand, if the engine is at idle and in the PTO mode, program control passes to conditional step 57. In this step, it is determined whether the mixing drum has been activated. If not, the routine passes at loop 58. This step 57 may be satisfied by the control signal used to initiate the route at step 50. Alternatively, separate signals can be required at the two step 50 and 57. For example, imitation of the routine can occur on activation of a switch on the cab control panel 25. Satisfaction of the condition stop 57 can then be determined by the manual control switch 33.

It is understood that each of the three conditional steps 51, 54, and 57 determine whether initial conditions have been met for commencement of the monitoring and control portions of the routine shown in FIG. 3. The conditions are intended to insure that the mixing drum 12 is not erroneously operated at the mixing speed, or otherwise operated under dangerous conditions. It is also understood that different initial conditions may be set forth and implemented by the drum rotation module 36 for the present invention. For instance, evaluation of the conditionals can be based upon user input or upon information received from sensors throughout the vehicle. For example, in one embodiment, a control switch 42 can be provided on the cab control panel 25 (FIG. 2). The control switch 42 can be used to place the engine in PTO mode and/or activate the mixing drum. Similarly, the manual controller 33 can perform either or both functions identified in conditional steps 54 and 57.

Once the initial conditions have been met, the program passes to step 60. In accordance with a central feature of the present invention, the routine determines a proper length of time for operation of the mixing drum 12 at its mixing speed. For instance, as explained in the background, certain standards or mixing conventions require a predetermined speed for a predetermined number of rotations of the mixing drum. In accordance with the present invention, then, the drum rotation module 36 determines a drum rotation time, which establishes a limit to the amount of time that the mixing drum 12 is operated at its higher mixing speed. According to the present embodiment, this mixing speed corresponds to the engine high rpm, as opposed to the engine low idle speed as described above.

When the drum rotation time is established in step 60, this value can be stored in the memory 37 of ECM 27 and referred to continuously by the drum rotation module 36. After the rotation time has been obtained, the module 36 directs the governor module 35 in step 62 to operate the engine at its high rpm. Of course, in alternative embodiments, the governor can be directed to control the engine at different speeds, depending upon the requirements for the particular vocational application of the vehicle. While the engine 15 is operating at the high rpm, power supplied through the PTO 17 and PTO shaft 19 to the drum motor controller 21 is sufficient to allow the motor 14 to drive the drum 12 at the proper mixing speed. The governor module 35 then operates concurrently with the drum rotation module 36 to regulate the engine speed at high idle in spite of variations in PTO load.

In one specific embodiment, this mixing speed is established by operator input to the drum motor controller 21 in a conventional fashion. This input can be at the controller 21 itself, or by way of the manual control switch 33 through databus 29. At any rate, in the specific implementation, operator control of the range of rotational speeds for the drum 12 is limited by the operation of the engine 15 at its high rpm.

In an alternative embodiment, the drum rotational speed can be dictated by operator input at the cab control panel 25. Thus in this embodiment, a pair of input switches 40 and 41 can be provided. One of the switches 40 can allow input of a specific drum rotation speed, while the other switch 41 can allow input of a specific number of drum rotations. The output from the control panel 25 is linked to the drum motor controller 21 by way of data bus 29. Thus, input from the drum speed switch 40 can be provided to the drum motor controller 21 to control the operating speed of the rotating drum 12. The output from the control panel, switches 40, 41 can also be provided to the ECM 27 and rotation module 36 to assist in the determination of the drum rotation time in step 60.

Referring again to FIG. 3, the engine operates at high idle only so long as the mixing drum is activated for operation at the mixing speed. Thus, in conditional step 64 a determination is made as to whether the drum has been deactivated, such as by operator input at manual control switch 33. If so, then control passes at loop 65 to the beginning of the conditional step 51. Of course, since the engine is operating at high idle at that time, it will fail the conditional step 51. In this case, control passes to step 53 in which the engine governor is set to the low idle speed. At this point, program control can be returned to the beginning of the drum rotation routine. Alternatively, once the drum has been deactivated and the engine speed returned to the low idle, the program can exit at step 66.

If the mixing drum has not been deactivated, then control passes to conditional step 67 in which it is determined whether the drum rotation time has expired. If not, control passes on loop 68 to determine whether the drum is then deactivated in conditional 64 or again whether the rotation time has expired in conditional step 67. The routine continues in this loop until the time has expired. In that case, the program flows to step 70 in which the drum rotation module 36 directs the engine speed governor module 35 to return the engine speed to the low idle condition. At that point, the routine returns at step 72 to the initial step 50 of the routine. Alternatively, the routine can exit to any other calling routine implemented by the ECM 27.

In accordance with certain features of the invention, the drum rotation module 36 automatically controls how long the vehicle engine 15 is operated at its high idle condition. As a consequence, the ECM 27 provides an automatic means for controlling the speed of the rotating mixing drum 12.

Once the engine speed drops from the high idle, PTO mode, condition to the low idle speed, the speed of rotation of the mixing drum 12 follows suit. The drum motor controller 21 and drive motor 14 are directly linked to the engine 15 and PTO 17 so that any reduction in engine speed leads to a commensurate reduction in drum rotation speed even without adjustment of the motor controller 21.

Preferably, the speed difference between the high idle and low idle conditions is sufficiently great to effect a dramatic decrease in drum rotation speed. By way of a specific example, a full load mixing speed for the drum 12 is 17 rpm. Thus, the drive motor 14 and drum motor controller 21 can be set so that operation of the engine 15 at its high rpm, say 2000 rpm, produces the requisite 17 rpm drum rotation rate. When the engine is dropped to its low idle speed, say 600 rpm, the drum rotation speed automatically drops proportionately to about 5 rpm. Further reduction in the drum rotation speed can be accomplished by manipulating the drum motor controller 21, until the drum is rotating at a preferred agitation rate, such as 2 rpm. At any rate, the drum rotation control module 36 according to the present invention automatically significantly reduces the speed of rotation of the drum, as well as the engine 15. This leads to an optimization of fuel usage for the engine and optimum decrease is the abrasive effects of high speed rotation of the aggregate contained within the mixing drum 12.

Figure 4:
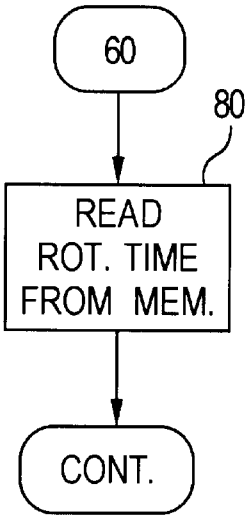
FIG. 4 is a subroutine for a determination step of the flow chart in FIG. 3, according to one embodiment.

In accordance with the present invention, various means are provided for determining the drum rotation time in step 60. Referring now to FIG. 4, one such method is illustrated. In this embodiment, the determination step 60 includes reading the drum rotation time from memory 37 in subroutine step 80. In this instance, the drum rotation time has been previously stored in the ECM memory prior to operation of the drum at its mixing speed. For example, an external tool can be linked to the ECM 27 to download a predetermined drum rotation time. This download can occur remote from the job site or at the job site. Other variations on this theme are contemplated. For instance, a number of predetermined time values can be stored in memory and selected by the operator. In addition, instead of securing storage of the time in memory, step 80 can be fulfilled by directly reading the time or the actual number of drum revolutions from an external tool.

Figure 5:
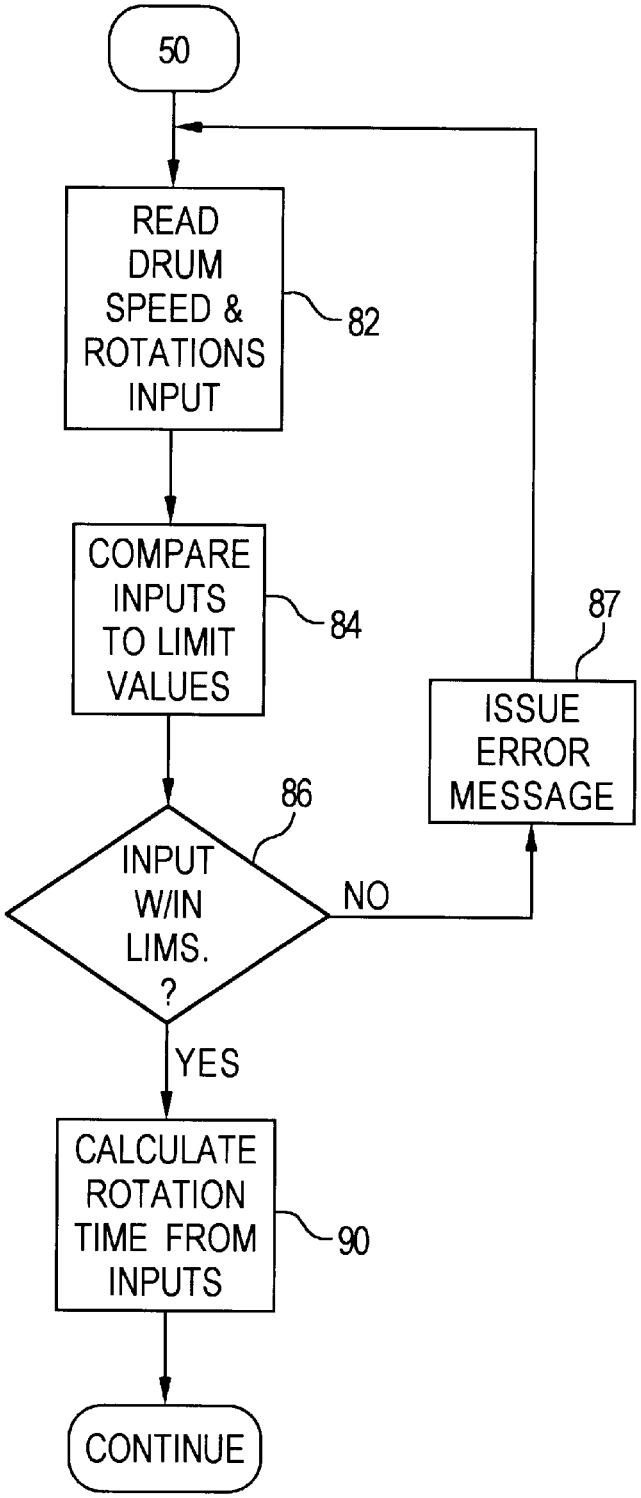
FIG. 5 is a flowchart of an alternative embodiment of the determination step of the flow chart shown in FIG. 3.

Another embodiment of the determination step 60 is depicted in the subroutine flow chart of FIG. 5. In this embodiment, values for drum rotation speed and number of rotations are read from a separate input at step 82. In the preferred embodiment of the invention, this input occurs at the cab control panel 25. More specifically, the control panel 25 includes a first switch 40 that provides means for entering the drum rotation speed, and a second switch 41 that provides means for entering the total number of drum rotations at the pre-set speed. In one specific embodiment, the switches 40 and 41 can comprise thumb wheel or dial-type switches that allow the operator to "dial in" a specific value. The switches 40, 41 can allow input of specific discrete values. For instances, the drum rotation speed switch 40 can allow input of certain selected rotation speeds, such as 6, 7, 8, etc., rpm. Likewise, the switch 41 for entry of the number of drum rotations can permit only certain discrete values, such a 70, 75, 80, etc., turns. Alternatively, the switches 40, 41 can be of the digital variety that permit incrementing and decrementing of an initial value. The initial value can a specific default value, such as 17 rpm and 70 revolutions.

Regardless of the in form, the switches 40, 41, provide the vocational vehicle operator with a means for entering specific values for drum rotation speed and number of drum rotations. This gives the operator the flexibility to determine what parameters are needed for the particular aggregate components and the specific job site. The output of the switches 40, 41 is provided to the ECM 27 by way of data bus 29. In addition, the value for the drum rotation speed entered at switch 40 can be provided to the drum motor controller 21 to set the speed of the drive motor 14.

In one feature of the invention, means are provided for insuring that the vehicle operator cannot enter inappropriate rotation speed and number of rotation values. This limiting feature can be integrated into the input switches 40 and 41 by restricting the values at which the switches can be set. Alternatively, and as depicted in FIG. 5, an additional step 84 can follow the input step 82 in which the input values are compared to predetermined limit values. These limit values can be stored in the memory 37 of the ECM 27. Preferably, the limit values fall within industry standard values, such as the TMMB protocol described above. The limit values can include a high limit and low limit value for the drum rotation speed input and a high number and low number for the number of rotations input. For example, in a full load mixing application, the high and low speed limits can be 18 and 6 rpm respectively, while the high and low number limits can be 100 and 70 turns, respectively. Additional limit values can be established for different applications of the vocational vehicle. For instance, in some cases it may be desirable to establish limits for agitating the aggregate components within the drum 12. In this case, the speed limit value can range from 1–6 rpm, while the number of revolutions can be limited to a maximum of 300 rotations.

The comparison step 84, thus, compares the specific input values, to predetermined limits to insure that proper mixing and/or agitation conditions are met. In the conditional step 86, if the values fall outside the limits, control passes to step 87 at which an error message is issued. The error message can be in the form of an annunciator on the cab control panel 25 or an audible alarm indicating that an improper set of values have been input at the switches 40, 41. The routine can return to the input step 82, or some other action can be taken by the routine implemented by the drum rotation module 36.

If the input values for drum speed and number of rotations are appropriate, control passes to a calculation step 90. At this step, the drum rotation time is calculated based upon the two inputs. More particularly, the calculation step 90 involves dividing the number of drum rotations by the drum rotation speed. For instance, if the number of input rotations is 70 at 17 rpm, the drum rotation time will be about 4 minutes and 7 seconds. This rotation time value can be maintained in memory 37 or a volatile memory of ECM 27 for use drum rotation module 36.

In many vocational applications, the subroutine of FIG. 5 is preferred because it provides the operator with a great deal of flexibility in entering the drum mixing parameters. In most instances, the vehicle operator has a greater awareness of appropriate drum rotation speed and number of rotations values than of the requisite time for rotating at the mixing speed. The present invention provides means automatically and internally calculates the proper drum rotation time from the operator input. The main routine shown in the flow chart of FIG. 3 can then use this rotation time to automatically reduce the engine speed to the low idle speed once the proper mixing time has expired.

Figure 6:
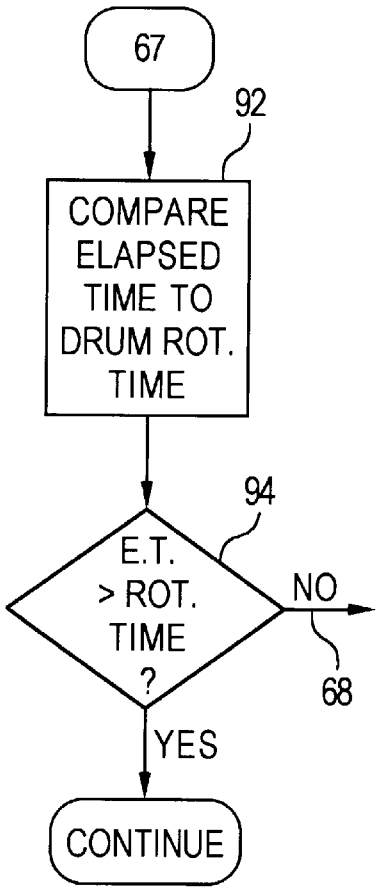
FIG. 6 is a subroutine for a conditional step of the flow chart in FIG. 3B, according to one embodiment of the invention.

The determination of the expiration of the drum rotation time is made in step 67. This determination can be made using one approach shown in the subroutine flow chart of FIG. 6. Specifically, in step 92 a comparison is made between the elapsed real time and the drum rotation time stored in a memory of the ECM 27. If the elapsed time exceeds the rotation time, at conditional 94 control passes to step 70 of the main routine in which the engine speed is reduced to low idle. On the other hand, if the elapsed time has not exceeded the rotation time, at conditional 94 control passes on loop 68 so that the engine continues to operate at the high rpm.

Using this approach, an elapsed time is maintained by the drum rotation module 36. The elapsed time can be obtained from the internal clock of the ECM 27. In one embodiment, a timer implemented within the drum rotation module 36 can be activated when the engine speed governor is set to the high rpm in step 62 of the main routine shown in FIG. 3. Alternatively, the drum rotation module 36 can utilize a counter that is incremented at each pass through loop 68 (FIG. 3). In this instance, the drum rotation time can be converted to a number of counts that are measured by the rotation module timer. Of course, the relationship between actual time and number of counts depends upon the cycle time through steps 64, 67 and loop 68.

In the preferred embodiment, the vehicle engine 15 is operated at its high rpm for an optimum period of time, designated the drum rotation time. This drum rotation time is based upon established standards for mixing speed and number of drum rotations. An important feature of the invention is that the ECM 27 automatically directs the engine 15 to its low idle speed once the drum rotation time has elapsed. With this feature, the material within the mixing drum 12 is properly and optimally mixed. Moreover, the engine 15 is driven at its high rpm only as long as necessary to provide a fully mixed concrete charge at the jobsite.

Figure 8:
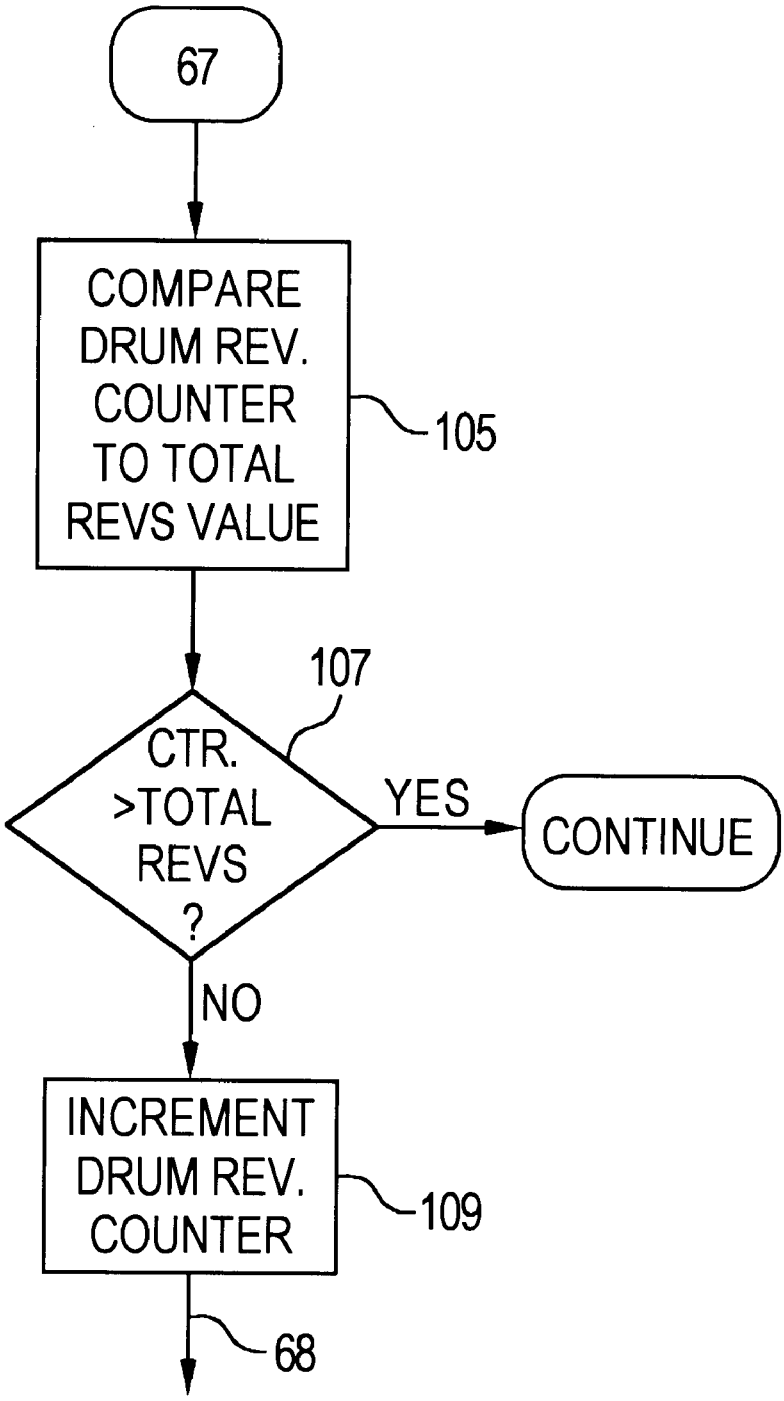
FIG. 8 is a subroutine for another embodiment of the conditional step of the flow chart in FIG. 3.

While the preferred embodiment of the invention relies upon a drum rotation time value, an alternative approach represented by the subroutine of FIG. 8, can utilize an actual count of drum rotations or revolutions. With this embodiment, a drum revolution counter 31, as illustrated in phantom lines in FIG. 2, can be incorporated into the system. This drum revolution counter 31 can be of known design and associated with either the drive motor 14 or the drum 12 itself. In one embodiment, the counter 31 provides a pulse signal along data bus 29 to the ECM 27, and most particularly to the drum rotation module 36.

With this embodiment, step 60 of the main routine of the flow chart in FIG. 3 involves a determination of the total number of drum rotations, rather than the drum rotation time. Similarly, the conditional step 67 involves the comparison of the drum revolution count to the total rotations value. Thus, step 67 can implement the subroutine shown in the flow chart of FIG. 8. More specifically, in step 105 a comparison can be made between the value generated by the drum revolution counter 31 to a total rotations value stored in the memory of the ECM 27. In the case where the drum revolution counter 31 itself maintains a current count, this count value can be passed on data bus 29 to the drum rotation module 36 and then compared to the total rotations value stored in memory. Alternatively, the drum rotation module 36 can include a counter that is incremented with each successive pulse generated by the drum revolution counter 31. This counter can be maintained in a non-volatile memory of the ECM 27, and read at step 105.

Following the comparison of the current counter to the total rotations value, conditional step 107 determines whether the current count has exceeded the total revolution value. Control passes to step 70 of the main routine at which the engine speed is dropped to the low idle speed. On the other hand, if the counter does not exceed the preset rotations value, control passes to step 109. At this step, the drum revolution counter is incremented and program flow continues on loop 68. With this step 109, the drum revolution counter can be based upon a number of counts corresponding to the amount of time for passage through the loop 68. Alternatively, the drum revolution counter can be separately incremented by the drum rotation module 36 or by the drum rotation sensor 31. In this case, step 109 can be eliminated and the subroutine of FIG. 8 can loop back to the comparison step 105. In the comparison step, the current value of the drum revolution counter can be read and compared each cycle through the loop 68 regardless of when the revolution counter is incremented.

As indicated above, the cab control panel 25 can include a switch 41 for entering a predetermined number of drum rotations. Thus, in step 60 as implemented in the embodiment of FIG. 8, the drum rotation value can be stored in short term memory for comparison in conditional step 107.

Figure 7:
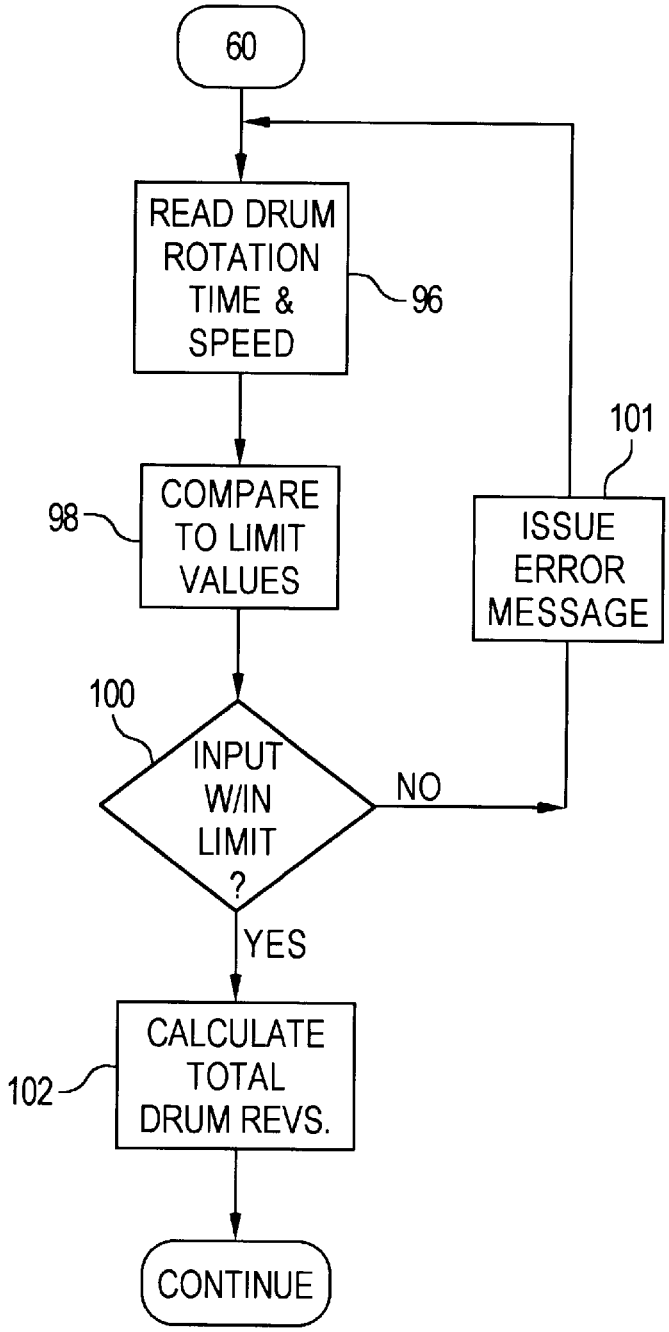
FIG. 7 is a subroutine for a further alternative embodiment of the determination step in FIG. 3.

Alternatively, a subroutine is shown in FIG. 7 can be applied at step 60. In this instance, a drum rotation time and speed value can be read in step 96. These two values can be obtained from a memory within the ECM or separately input by the vehicle operator. As with the subroutine shown in FIG. 5, the drum rotation time and speed values can be compared to predetermined limit values in step 98 and pass through a conditional 100. If the user entered rotation time and speed values are inappropriate, an error message can be issued at step 101 and control returned to the top of the subroutine. Alternatively, if the input values are proper—i.e. within predetermined limits—the total drum revolutions can be calculated in step 102 by multiplying the drum rotation time and speed values together. With this subroutine, the comparison at step 67 involves comparing the current drum revolution counter to the total drum revolution value based on the user input.

With each of the embodiments illustrated above, the vehicle engine is operated only as long as necessary for optimum mixing or agitation of the concrete aggregate material. Dropping the engine speed from high idle to low idle automatically avoids any problems associated with operator interaction with the system. In addition, since the system and method of the present invention happens in the background, independent checks can be made to insure that the mixing drum 12 is not rotated too few or too many times at too high or too low a speed. Moreover, since the preferred embodiments of the invention are software based, various drum rotation protocols can be applied. For example, an intermediate idle speed can be provided for relatively higher speed agitation speed of the aggregate. In addition, a rotation speed profile can be applied based upon profile information stored in the ECM memory 37 and extracted by the drum rotation module 36.

A further benefit of the inventive system and method is that information concerning the drum rotation history can be stored in ECM memory for subsequent downloading. For instance, the number of rotations of the mixing drum 12 at a specific speed can be stored in memory and later used to display the mixing truck duty cycle. In addition, counting the number of drum revolutions can be used to monitor the mixing drum life cycle. In other words, the mixing drum life cycle values can be used to determine the amount of wear that the drum has experienced, which affords the vehicle operator owner the opportunity to repair or replace the drum for optimum efficiency.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

For instance, while the illustrated embodiment concerns a mobile cement mixing vehicle, other vocational applications can utilize the principles of the present invention. The invention can be applied to control engines providing power to a driven industrial component that requires maintenance of a specific speed for a predetermined time period.

In addition, the present invention can be applied to control the engine operation to a predetermined speed range, rather than a specific speed. Thus, in the embodiment of the mixing truck, the engine speed governor can be permitted to control the engine at a high rpm range during full charge mixing. In this circumstance, the calculation of the drum rotation time effected in step 60 of the main routine can operate interactively.

In other words, the module can evaluate the current drum rotation speed based on the current engine speed and the speed ratio between the engine and mixing drum. The time to completion of the requisite number of drum rotations can be re-assessed based on this current drum rotation speed. When the drum is rotating at a speed at the high end of the range, the time required for the necessary drum rotations decreases, and vice versa for drum speeds at the low end of the range. With this approach, the engine will be maintained at high rpm only for the predetermined number of drum rotations.

Alternatively, the number of drum rotations can also be established within a fixed range. With this approach, variations in engine speed within an expected range will not alter the total number of drum rotations outside the preferred range of values. With either of these modifications, once the mixing drum has completed its required number of rotations, or the calibrated mixing time has expired, the drum rotation module 36 directs the engine speed governor 35 to return the engine to its low idle speed.

What is claimed is:

1. A system for controlling the speed of an engine providing power to a mixing drum, said system comprising:

a control module operable to control the speed of the engine at a first speed sufficient to power the mixing drum and at a lower second speed;

a timer for measuring the elapsed time that the control module controls the engine speed at said first speed;

a controller operable to direct the control module to control the engine speed at said second speed when said elapsed time equals a threshold value;

a counter for generating a counting signal indicative of the number of revolutions of the mixing drum; and means within the timer for calculating the elapsed time from the counting signal.

2. The system for controlling the speed of an engine according to claim 1, wherein said first speed is an engine high rpm and said second speed is an engine low idle speed.

3. The system for controlling the speed of an engine according to claim 1, wherein said first speed is a speed sufficient for desired mixing of material contained in the mixing drum, and said second speed is an engine idle speed.

4. The system for controlling the speed of an engine according to claim 3, wherein said threshold value is a time limit for desired mixing of the material when the engine is operating at said first speed.

5. The system for controlling the speed of an engine according to claim 1, wherein said controller includes input means for operator input of said threshold-value.

6. The system for controlling the speed of an engine according to claim 5, wherein said input means includes a control panel associated with the engine and accessible by the operator for data entry.

7. The system for controlling the speed of an engine according to claim 5, wherein said input means includes an input tool selectively engageable with said controller to transmit data thereto.

8. The system for controlling the speed of an engine according to claim 1, in which the driven component is a mixing drum, wherein said controller includes:

input means for operator input of a speed value corresponding to a desired rotation speed for the mixing drum and a revolutions value corresponding to a desired total number of revolutions of the mixing drum; and means for calculating said threshold value from said speed value and said revolutions value.

9. The system for controlling the speed of an engine according to claim 8, wherein said input means includes a control panel associated with the engine and accessible by the operator for data entry.

10. The system for controlling the speed of an engine according to claim 9, wherein said control panel includes at least one control switch operable to increment and to decrement at least one of said speed value and said revolutions value by a fixed increment.

11. The system for controlling the speed of an engine according to claim 8, wherein the controller further includes:

a memory for storing a range of acceptable values for at least one of said speed value and said revolutions value; and a comparator operable to compare at least one of said operator input speed value and revolutions value to said range of acceptable values, said comparator generating an error signal if said at least one value is outside said range of acceptable values.

12. The system for controlling the speed of an engine according to claim 8, wherein said input means includes an input tool selectively engageable with said controller to transmit data thereto.

13. The system for controlling the speed of an engine according to claim 1, wherein said controller is responsive to an external signal to direct the control module to control the engine speed at said first speed.

14. In a concrete mixing vehicle having an engine driving a motor operable to rotate a mixing drum, the operating speed of the engine being controlled by signals from an engine control module (ECM), the ECM operable to control the engine speed at an idle speed and at a mixing speed corresponding to a speed of the mixing drum sufficient to mix material contained within the drum, a system for controlling engine speed comprising:

means for determining an elapsed time that the ECM has controlled the engine speed at the mixing speed;

means for directing the ECM to control the engine speed at the idle speed when said elapsed time equals a threshold value; and a counter for generating a counting signal indicative of the number of revolutions of the mixing drum;

wherein the means for determining an elapsed time includes means for calculating the elapsed time from the counting signal.

15. The system for controlling engine speed according to claim 14, wherein said means for directing is responsive to an external signal to direct the ECM to control the engine speed at said mixing speed.

16. In a concrete mixing vehicle having an engine driving a motor operable to rotate a mixing drum, the operating speed of the engine being controlled by signals from an engine control module (ECM), the ECM operable to control the engine speed at an idle speed and at a mixing speed corresponding to a speed of the mixing drum sufficient to mix material contained within the drum, a system for controlling engine speed comprising:

means for determining an elapsed time that the ECM his controlled the engine speed at the mixing speed; and means for directing the ECM to control the engine speed at the idle speed when said elapsed time equals a threshold value including input means for operator input of a speed value corresponding to a desired rotation speed for the mixing drum and a revolutions value corresponding to a desired total number of revolutions of the mixing drum, and means for calculating the threshold value from said speed value and said revolutions value.

17. The system for controlling engine speed according to claim 16, wherein said input means includes a control panel associated with the vehicle and accessible by the operator for data entry.

18. The system for controlling engine speed according to claim 16, wherein said input means includes an input tool selectively engageable with said means for directing to transmit data thereto.

19. The system for controlling engine speed according to claim 16, wherein said means for directing is responsive to an external signal to direct the ECM to control the engine speed at said mixing speed.

* * * * *